US007191843B2

(12) United States Patent
Wong

(10) Patent No.: US 7,191,843 B2
(45) Date of Patent: Mar. 20, 2007

(54) VALVE APPARATUS WITH SEAL ASSEMBLY

(75) Inventor: Fredrick Sun-Veow Wong, Mandeville, LA (US)

(73) Assignee: PetroQuip Energy Services, Inc., Houston, TX (US)

( * ) Notice: Subject to any disclaimer, the term of this patent is extended or adjusted under 35 U.S.C. 154(b) by 257 days.

(21) Appl. No.: 10/875,411

(22) Filed: Jun. 24, 2004

(65) Prior Publication Data

US 2005/0284642 A1 Dec. 29, 2005

(51) Int. Cl.
*E21B 34/14* (2006.01)

(52) U.S. Cl. ..... 166/386; 166/332.4; 166/332.7; 166/324

(58) Field of Classification Search ..... 166/386, 166/332.4, 332.7, 324
See application file for complete search history.

(56) References Cited

U.S. PATENT DOCUMENTS 3,151,681 A * 10/1964 Cochran ..... 166/332.4
5,156,220 A 10/1992 Forehand et al.
5,263,683 A * 11/1993 Wong ..... 251/145
5,309,993 A * 5/1994 Coon et al. ..... 166/115
5,316,084 A * 5/1994 Murray et al. ..... 166/332.4
6,318,729 B1 * 11/2001 Pitts et al. ..... 277/511
2003/0056951 A1 * 3/2003 Kaszuba ..... 166/250.01

* cited by examiner

*Primary Examiner*—Hoang Dang
(74) *Attorney, Agent, or Firm*—C. Dean Domingue; Robert L. Waddell; Ted M. Anthony

(57) ABSTRACT

A valve apparatus. The valve apparatus is disposed within a well so that an annulus is formed between an outer portion of the valve and an inner portion of the well. In one preferred embodiment, the valve apparatus comprises an outer mandrel containing an annulus port; an inner mandrel slidably disposed within the outer mandrel, and wherein the inner mandrel contains a production and equalizing port. The valve contains a seal assembly so that pressure from the annulus is isolated from the inner portion of the inner mandrel. In one preferred embodiment, the seal assembly comprises: a first header seal; a first seal ring, abutting the header seal, for sealing with the outer portion of the inner mandrel; a follower seal abutting the seal ring; a second seal ring, abutting the follower seal, for sealing with the outer portion of the inner mandrel; a second header seal; and an equalizing seal abutting the second seal ring.

23 Claims, 13 Drawing Sheets

VALVE APPARATUS WITH SEAL ASSEMBLY

BACKGROUND OF THE INVENTION

This invention relates to a production control device. More particularly, but not by way of limitation, this invention relates to a production control device used in the production of hydrocarbons from subterranean reservoirs and its method of use.

In the production of hydrocarbons from a well, operators may find it necessary to either open a port within a tubular string or close a port within a tubular string. A valve placed in a tubular string can be used to establish communication with the reservoir, or alternatively, to shut-off communication with the reservoir. Several devices have been developed over the years to accomplish the opening and/or closing of ports. These devices are generally known as sliding sleeves due to the ability to shift an inner sleeve from a first position to a second position. Sliding sleeves are commercially available from several vendors. One type of sliding sleeve that is commercially available is sold under the name "Otis DuraSleeve" and may be purchased from Halliburton Corporation.

One of the major problems with these prior art down hole devices is the seals. After the sleeve has been shifted from the closed position to the open position with a differential pressure greater than 2500 psi, the valves would leak when shifted back to the closed position. The cause of the failure is generally cutting or clipping of the seals as the equalizing ports and the sleeve production ports pass under the seals. The cutting is a result of a change in the physical properties of the seals at temperatures above 250 degrees Fahrenheit. For instance, the tensile strength of a Viton seal ring (Viton is a trademark of Dupont Corporation) at 70 degrees Fahrenheit is between 1250 psi to 2000 psi; however, at 210 degrees Fahrenheit, the tensile strength is less than 200 psi. The tensile strength of a Teflon seal ring (Teflon is a trademark of Dupont Corporation) at 70 degrees Fahrenheit is between 2500 psi to 3000 psi; however, at 210 degrees Fahrenheit, the tensile strength is less than 500 psi.

Therefore, there is a need for a device that can be selectively opened and closed in a well. There is also a need for a device that can be shifted from a closed position to an open position, or alternatively from an open position to a closed position, without harming the seal assembly. There is also a need for a seal assembly within a down hole device that will continue to provide for a seal after multiple openings and closings of the down hole device. These, as well as many other needs, will be met by the following invention.

SUMMARY OF THE INVENTION

A valve apparatus is disclosed. The valve apparatus is disposed within a well so that an annulus is formed between an outer portion of the valve and an inner portion of the well. In one preferred embodiment, the apparatus comprises an outer mandrel, wherein the outer mandrel contains an annulus port; an inner mandrel slidably disposed within the outer mandrel, the inner mandrel containing an inner portion and an outer portion, and wherein the inner mandrel contains a production port, and an equalizing port; a seal assembly disposed within an indentation formed on the outer mandrel, the seal assembly engaging the outer portion of the inner mandrel so that pressure from the annulus is isolated from the inner portion of the inner mandrel.

In one preferred embodiment, the seal assembly comprises: a first header seal member; a first seal ring means, abutting the first header seal member, for sealing with the outer portion of the inner mandrel; a follower seal member abutting the first seal ring means; a second seal ring means, abutting the follower seal member, for sealing with the outer portion of the inner mandrel; a second header seal member; and an equalizing seal member abutting the second header seal member.

The apparatus will have an open position and a closed position and wherein in the closed position, the equalizing port and the production port are isolated from the annulus port and wherein in the open position the annulus port and the production port are aligned so that the annulus and the inner portion of the inner mandrel are in communication.

The apparatus may further comprise a vent groove disposed on the outer portion of the inner mandrel, the vent groove having a leading edge that extends through the equalizing port and wherein the vent groove further extends to the production port.

In one preferred embodiment, the first and second seal ring means comprises a first seal ring abutting a non-extrusion seal member, and the first and second header seal member may comprise a radially flat outer portion and an angled inner portion, wherein the angled inner portion is between 80 degrees and 20 degrees relative to a transverse groove. The first and second seal ring means may comprise a curved outer portion and an angled inner portion, wherein the angled inner portion is between 80 degrees and 20 degrees relative to a first transverse groove.

The follower seal member may contain a cavity for placement of an o-ring, and wherein the o-ring will engage the inner portion of the outer mandrel and wherein the follower seal member provides for a thrust load mechanism to energize the first and second seal ring. The equalizer seal member may contain a top surface that includes a cavity for placement of an o-ring, and wherein the o-ring will engage the inner portion of the outer mandrel providing a static seal, and wherein the top surface provides for a dynamic seal with the outer mandrel. In the preferred embodiment, all the seals may be constructed of Teflon, or a polyester ester ketone material (PEEK), or other equivalent material.

In one preferred embodiment, the well is completed to a hydrocarbon bearing subterranean reservoir and the apparatus is part of a production tubing string so that hydrocarbons can be produced from the reservoir through the apparatus and into an inner portion of the production tubing string.

In another embodiment, a down hole apparatus disposed within a well so that an annulus is formed is disclosed. The down hole apparatus includes an outer mandrel, and an inner mandrel slidably disposed within the outer mandrel. A seal assembly is contained within the down hole apparatus. The seal assembly comprises a header seal member, a first seal ring means for sealing with the outer portion of the inner mandrel and a second seal ring means for sealing with the outer portion of the inner mandrel. The seal assembly further comprises means, disposed between the first and second seal ring means, for thrust loading the first and second seal ring means, and means, operatively associated with the second seal ring, for providing a static seal with inner portion of the outer mandrel and a dynamic seal with the inner mandrel. The down hole apparatus may be a packer, a valve, a sub-surface power generator Oar), chokes, and other equivalent devices.

A method of producing a well completed to a subterranean hydrocarbon reservoir, with the well having a concentrically disposed tubular string, is also disclosed. The method comprises providing a sliding sleeve in a closed position, with the sliding sleeve comprising: an outer mandrel having an annulus port there through; an inner mandrel slidably disposed within the outer mandrel, and wherein the inner mandrel contains a production port and an equalizing port; a seal assembly disposed about the outer mandrel, the seal assembly engaging the outer portion of the inner mandrel so that pressure from the reservoir is isolated from the inner portion of the inner mandrel; and wherein the seal assembly comprises: a first header seal member; a first seal ring member, abutting the header seal member; a follower seal member abutting the seal ring member; a second seal ring member; a second header seal member abutting the second seal ring member; and, an equalizing seal member abutting the second header seal member. The method further includes shifting the inner mandrel in a first direction and moving the leading edge of the vent groove pass the first header seal member.

Next, the pressure is vented between the follower seal member and the first seal ring member and then pressure is vented between the follower seal member and the second seal ring member. The method includes moving the inner mandrel so that the annulus port and the production port are aligned in an open position, and communicating the annulus and the inner portion of the inner mandrel. The hydrocarbons from the reservoir may then be produced by flowing the hydrocarbons through the annulus port, production ports, and into the inner portion of the sliding sleeve.

In one preferred embodiment, the header seal members comprise a radially flat outer portion and an angled inner portion, wherein the angled inner portion is between 80 degrees and 20 degrees relative to a transverse groove in the header seal members. In another preferred embodiment, the first and second seal ring means comprises a curved outer portion and an angled inner portion, wherein the angled inner portion is between 80 degrees and 20 degrees relative to a transverse groove in the first and second seal ring member.

The follower seal member may contain a cavity for placement of an o-ring, and wherein the o-ring will engage the outer portion of the inner mandrel. The equalizer seal member may contain a top surface that includes a cavity for placement of an o-ring, and wherein the o-ring will engage the inner portion of the outer mandrel providing a static seal, and wherein the top surface provides for a dynamic seal with the outer mandrel.

In one of the preferred embodiments, the well is completed to a hydrocarbon bearing subterranean reservoir and the sliding sleeve is part of a production tubing string so that hydrocarbons can be produced from the reservoir through the sliding sleeve and into an inner portion of the production tubing string.

An advantage of the present invention is that the valve of the present invention may be used as a sliding sleeve apparatus. Another advantage of the present invention is that the equalizing seal prevents high differential pressure and high volume flow rate from reaching the seal rings. Another advantage is that the equalizer seal comprises two seals—a dynamic seal ring and a static seal ring. Another advantage is that the seals provide gas tight soft seals. Still yet another advantage is that the equalizing seal provides linear thrust load that will energize the flanks of the seal rings and in turn create a soft seal.

Another advantage is that PEEK seal rings may be used, and the pressure rating of the valve can be raised. Another advantage is that by changing the direction of the seal stack will produce less damage and will not trap pressure between opposing seal faces. This will require the addition of another follower ring to provide a thrust load to energize the seal ring.

A feature of the present invention is that the follower seal provides bi-directional linear thrust load to energize the seal rings in both directions. Another feature is that the seating angle on each seal ring and header is designed to reduce the shifting force required to shift the sleeve with a high differential pressure across the seals. Yet another feature is that the optional back rings prevent extrusion into the adjacent seal ring.

Still yet another feature is the seal rings were designed with the minimal groove and a shallow tapered flank angle to allow for deflection of the seal ring. The flanks of the seals were designed as pressure vessels. Another feature is that the equalizing ports in the sleeve were designed to control the flow rate across the seal. In addition, the width of the grooves were also designed to prevent over stressing the seal rings.

Another feature is that the vent grooves are designed to prevent pressure from re-energizing the seal rings. In addition, the grooves are very shallow to prevent extrusion of the seal rings in the vent groove. Yet still another feature is that the seal assembly can be used with packers, chokes, jars and safety valves.

DETAILED DESCRIPTION OF THE PREFERRED EMBODIMENTS

Figure 1A:
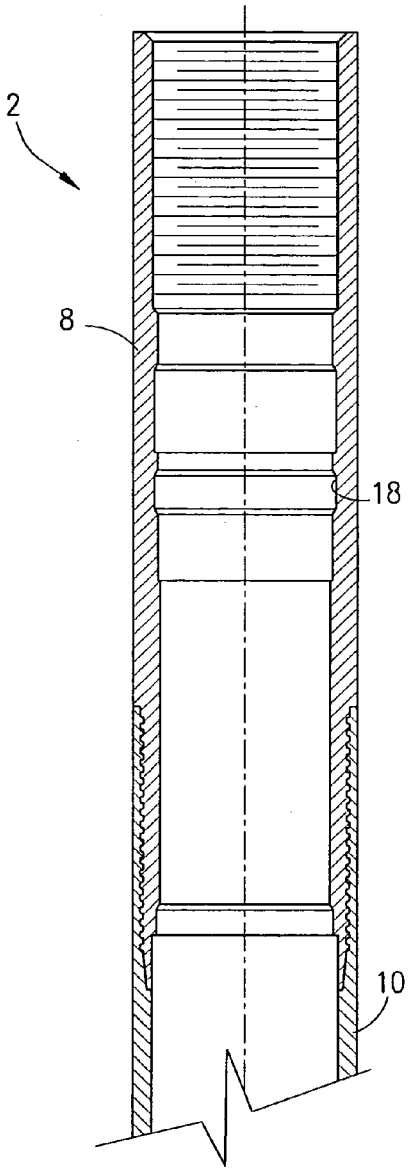
FIGS. 1A–1C is a cross-sectional view of the one of the preferred embodiments of the sliding sleeve assembly depicted in the open position.
Figure 1B:
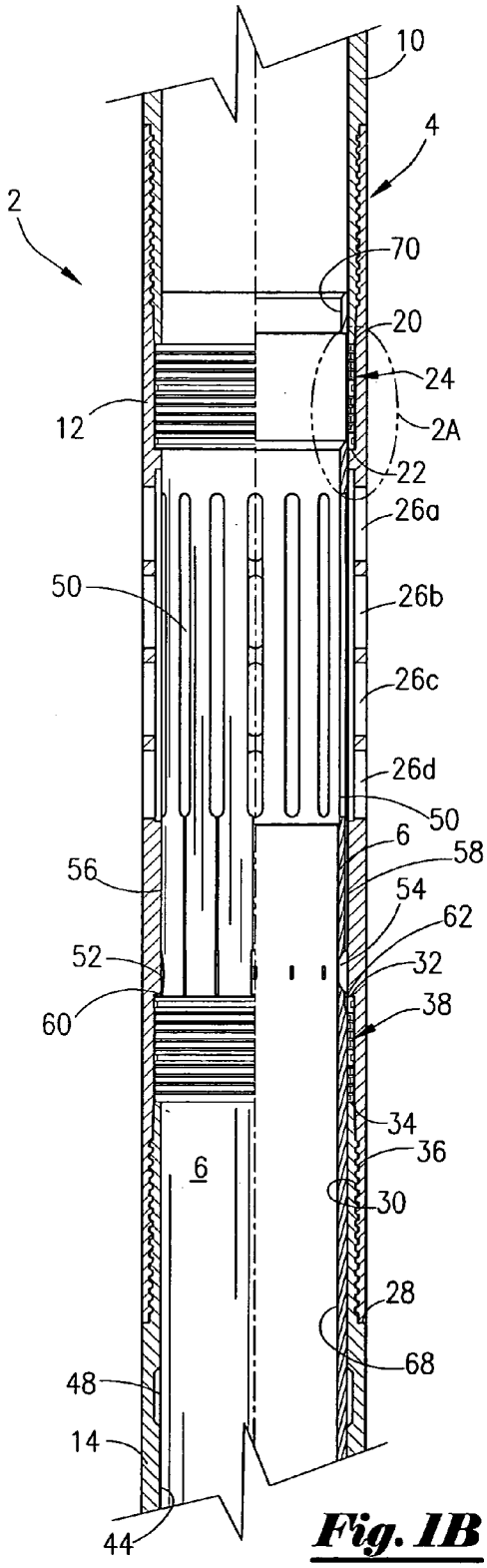
Figure 1C:
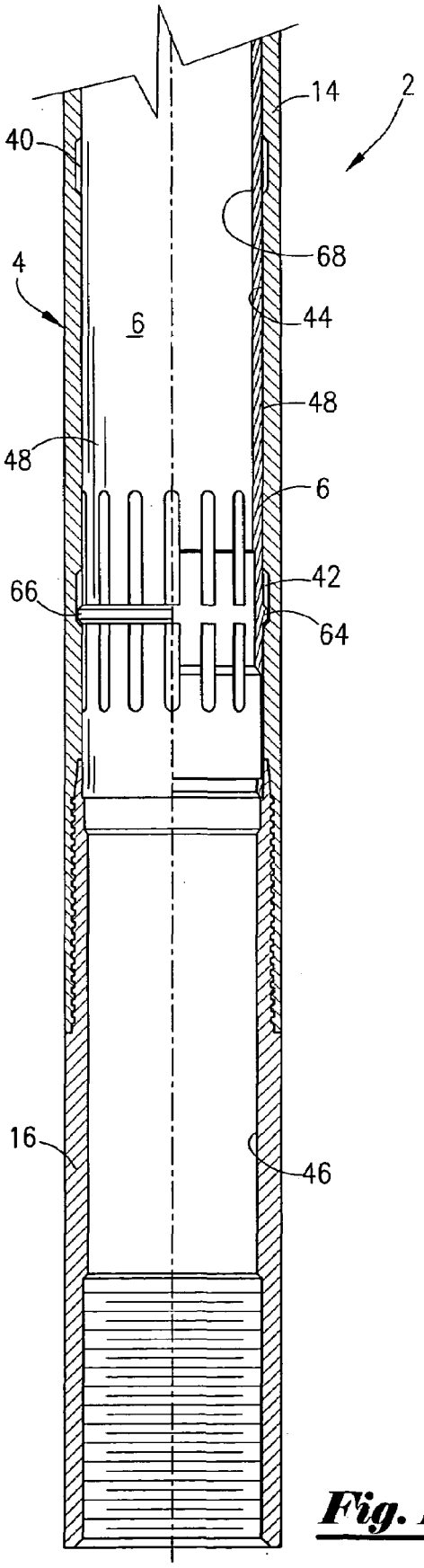

Referring now to FIGS. 1A–1C, a partial cross-sectional view of one of the preferred embodiment of the sliding sleeve assembly 2 in the open position will now be described. The assembly 2 includes an outer mandrel, seen generally at 4, as well an inner mandrel, seen generally at 6, and wherein the inner mandrel 6 is concentrically disposed within the outer mandrel 6. The outer mandrel 4 includes a first sub 8, second sub 10, third sub 12, fourth sub 14 and fifth sub 16 that are threadedly attached in series. The first sub 8 contains an internal locking nipple profile, seen generally at 18. The second sub 10 has a radial end 20. As shown in FIG. 1B, the third sub 12 is threadedly attached to the second sub 10. An internal shoulder 22 located on the third sub 12 will cooperate with the radial end 20 to form an indentation for a first seal assembly 24. The seal assembly 24 will be described in greater detail later in the application.

The third sub 12 contains a plurality of annulus ports such as annulus ports 26*a*, 26*b*, 26*c* 26*d*, and wherein the annulus ports will allow communication through the third sub 12. The third sub 12 contains a radial end 28, and extending radially inward is the internal threads 30 which in turn extends to the radial shoulder 32. The fourth sub 14 has the radial end 34 that extends to the external threads 36 that will engage with the internal threads 30. The radial shoulder 32 and the radial end 34 cooperate to form an indentation for placement of a second seal assembly 38.

The fourth sub 14 contains a plurality of grooves 40, 42, wherein the grooves 40, 42 are placed on the inner portion 44 of the fourth sub 14. The grooves 40, 42 will engage with a protuberance located on the inner mandrel 6 for movement of the inner mandrel 6. As seen in FIG. 1C, the fourth sub 14 will be threadedly connected to the fifth sub 16. The fifth sub 16 has an inner portion 46 that includes the internal profile for a shifting tool (not shown) to engage for movement of the sleeve as understood by those of ordinary skill in the art.

The inner mandrel 6 will now be described. As seen in FIG. 1B, the inner mandrel 6 contains an outer portion 48 that will cooperate with the first seal assembly 24 and the second seal assembly 38. The inner mandrel 6 also contains a plurality of elongated production ports, seen generally at 50. The inner mandrel 6 also contains equalizing ports, such as equalizing ports 52 54. A first vent groove and second vent groove, seen at 56, 58 respectively is included. The vent grooves are grooves milled within the outer portion 48 of the inner mandrel 6. The leading edge 60, 62 of the vent grooves 56, 58 will extend below the ports 52, 54 and wherein the vent grooves 56, 58 extend linearly along the inner mandrel 6 to the production ports 50 as shown.

As seen in FIG. 1C, the outer portion 48 will contain the protuberances 64. 66, hereinafter referred to as the dogs 64, 66, wherein the dogs will cooperate with the grooves 40, 42 for movement of the inner mandrel 6 relative to the outer mandrel 4, as will be understood by those of ordinary skill in the art. The inner portion 68 of the inner mandrel 6 includes the internal latching neck 70, and wherein the latching neck 70 (seen in FIG. 1B) is configured to engage a latching tool (not shown) in order to slide the inner mandrel 6 from the closed position to the open position, or alternatively, from the open position to the closed position.

Figure 2D:
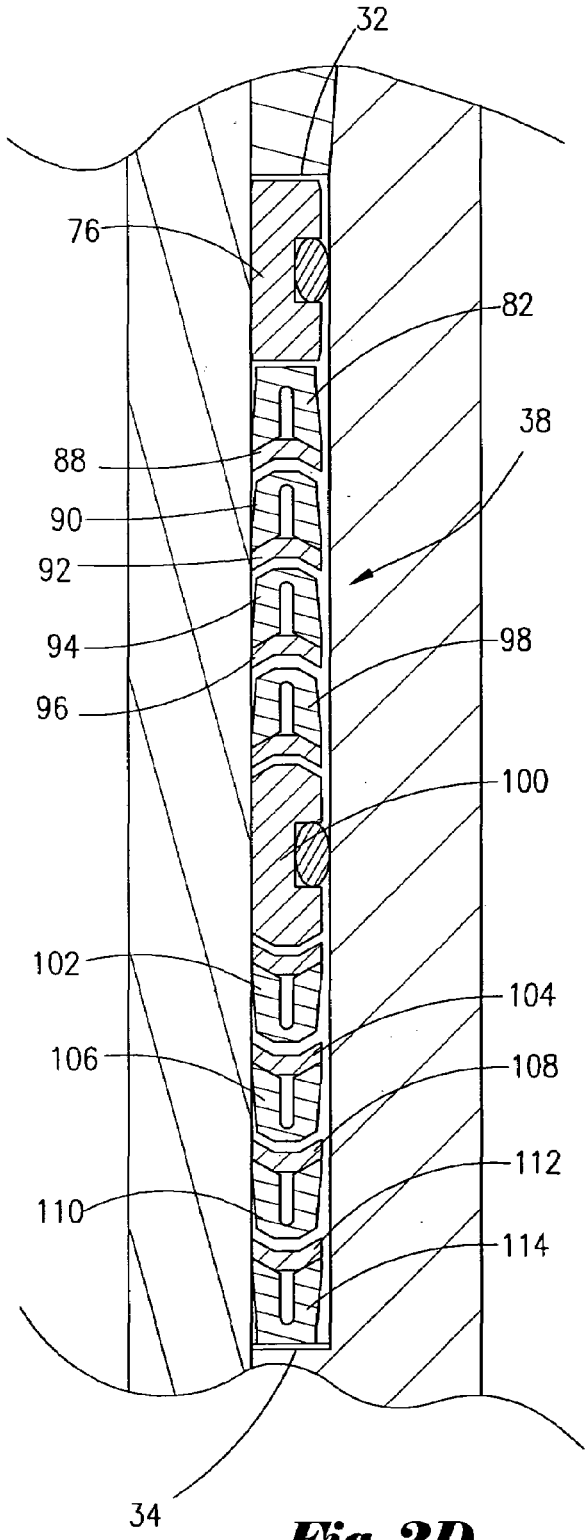
FIG. 2D is an exploded view of a most preferred embodiment of the lower seal assembly taken from FIG. 1B.
Figure 2A:
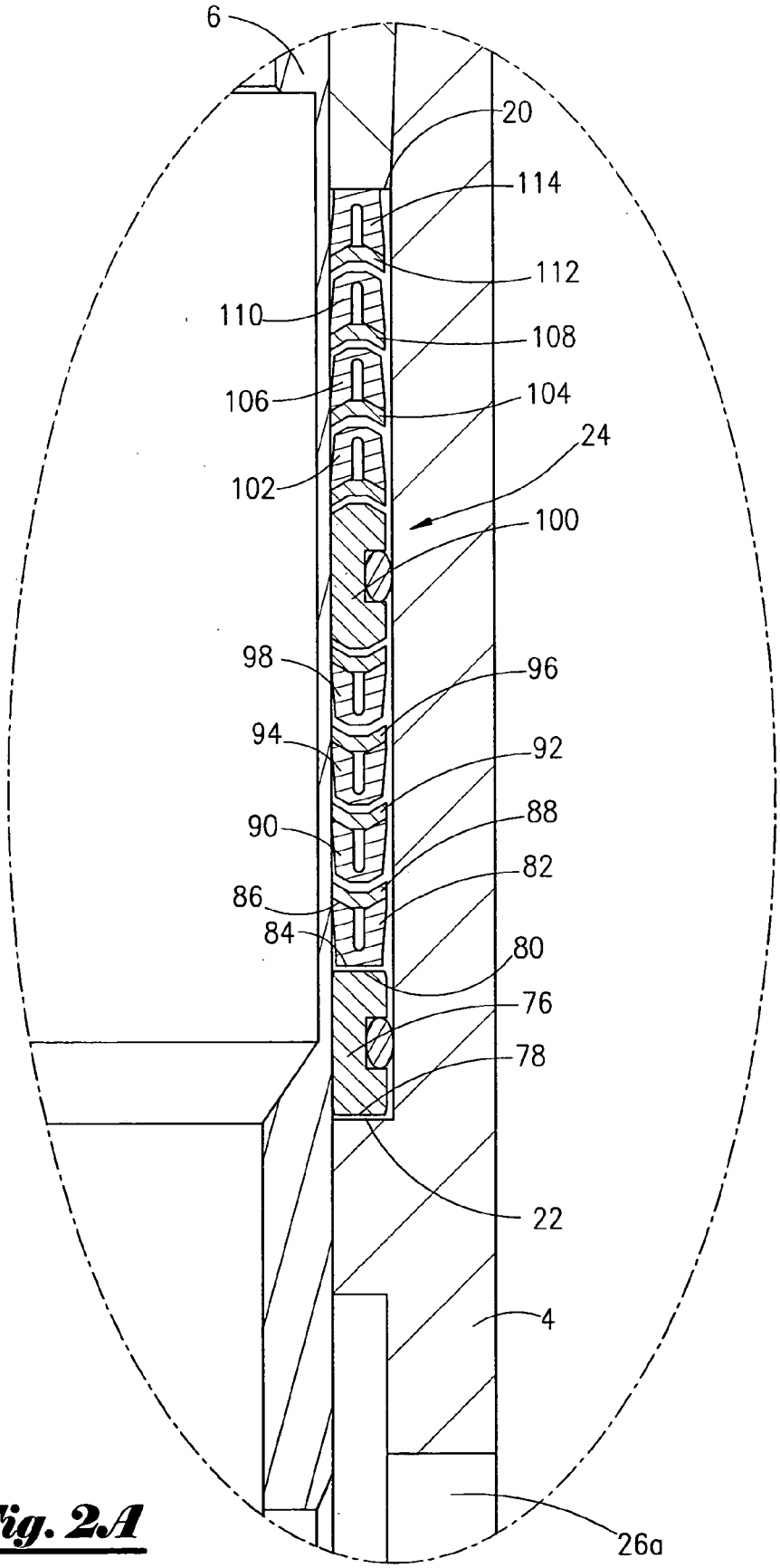
FIG. 2A is an exploded view of the most preferred embodiment of the seal assembly taken from FIG. 1B.

Referring now to FIG. 2A, an exploded view taken from FIG. 1B of the most preferred embodiment of the seal assembly 24 will now be described. It should be noted that like numbers appearing in the various figures refer to like components. Additionally, the components and the sequence of the seal assembly 38 are the same as seal assembly 24 except that the assembly 38 is reversed, as seen in FIG. 2D. Returning to FIG. 2A, the seal assembly 24 is placed within an indentation formed from the inner portion of the mandrel 4, the outer portion of the mandrel 6, the radial shoulder 22 and the radial end 20. The seal assembly 24, in the most preferred embodiment, comprises an equalizing seal means 76, wherein the equalizing seal means 76 is constructed of filled PEEK which is commercially available from Green Tweed under the name Arlon. The PEEK has a tensile strength greater than 25,000 psi at 70 degrees F, and 13,000 psi at 350 degrees F. As understood by those of ordinary skill in the art, all seal means of the seal assembly 24, 38 may be constructed of any equivalent type of material such as Teflon, and wherein Teflon is a registered trademark of Dupont Corporation.

An end 78 of the equalizing seal means 76 abuts the radial shoulder 22 and the opposite end 80 abuts the header seal ring means 82. The header seal means 82 is constructed of filled PEEK. The header seal means 82 has a first end 84 and a second angled end 86. In the most preferred embodiment, a non-extrusion ring 88 is included, and wherein the non-extrusion ring 88 is constructed of filled PEEK. The non-extrusion ring 88 comprises a concave shape and its function is to prevent the extrusion and bulging of the ring members on either side.

The seal assembly 24 will further comprise a first seal ring means 90. In the most preferred embodiment, the seal ring means 90 is constructed of filled PEEK. In the preferred embodiment shown in FIG. 2A, a second non-extrusion ring 92 is provided, which in turn leads to a second seal ring means 94. As seen in FIG. 2, a third non-extrusion ring 96 is placed in series which in turn abuts the third seal ring means 98. Next, the seal assembly 24 will include a follower seal ring 100, which is constructed of filled PEEK. The follower seal ring 100 has a first and second curved surface. A fourth seal ring means 102 is included wherein one end will abuts the follower seal ring 100 and the other end abuts the non-extrusion ring 104. It should be noted that according to the teachings of the present invention, at least one seal ring means is necessary on each side of the follower seal ring 100 i.e. a total of two seal rings, one on each side of the follower seal ring 100. It is also possible to omit the non-extrusion rings. Alternate seal assembly embodiments will be described later in the discussion of FIGS. 2B and 2C.

Returning to FIG. 2A, a fifth seal ring means 106 is provided that will in turn abut the non-extrusion ring 108. The non-extrusion ring 108 will then abut the sixth seal ring means 110 that in turn will abut the non-extrusion ring 112. The non-extrusion ring 112 will abut the header seal ring 114. As seen in FIG. 2A, the header seal ring 114 will have an angled end abuting the back side of the non-extrusion ring 108 and a second radially flat end that will abut the radial end 20.

Figure 3:
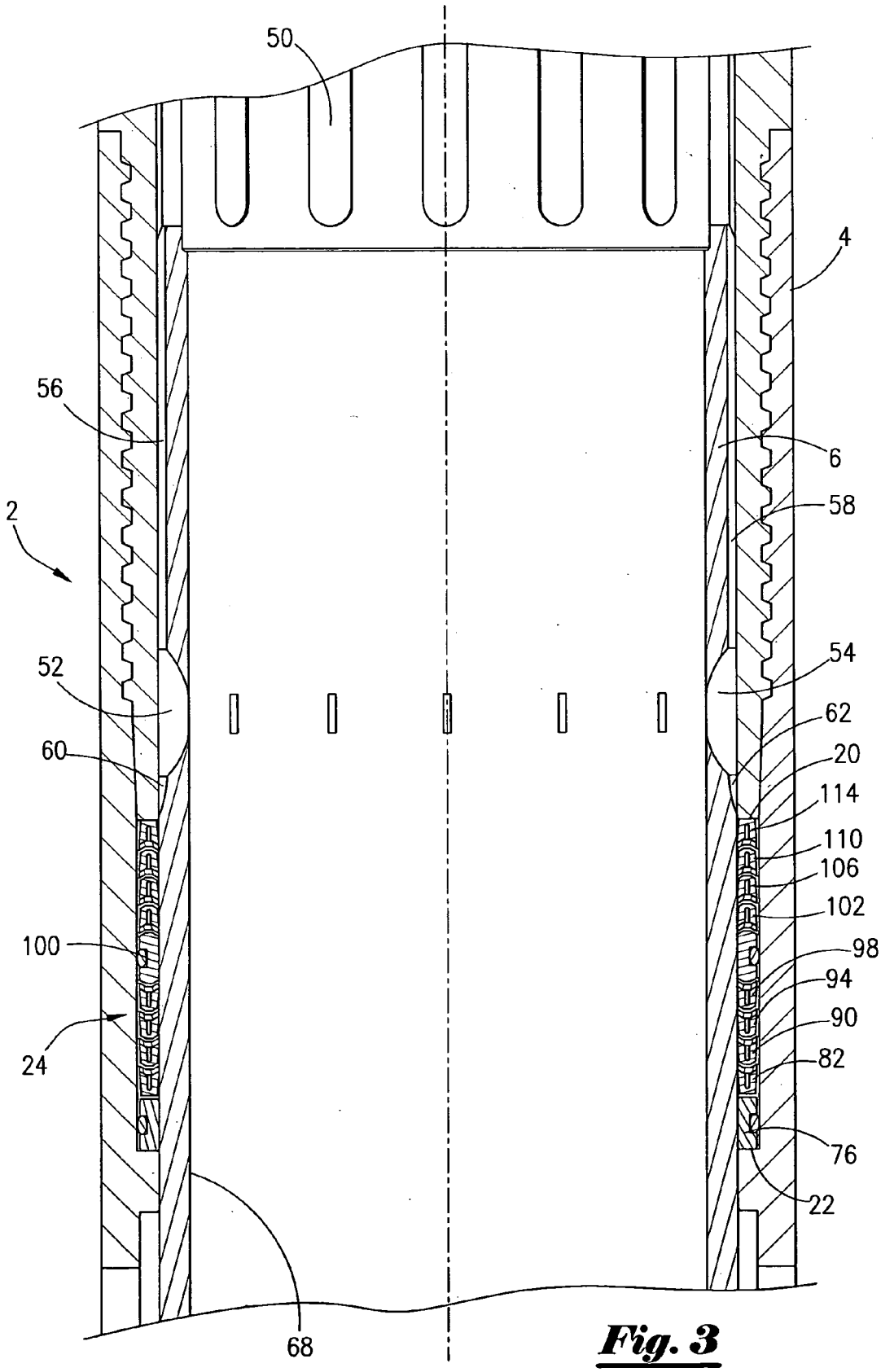
FIG. 3 is a partial cross-sectional view of the sleeve device in the closed position.

Referring now to FIG. 3, a partial cross-sectional view of the sliding sleeve assembly 2 in the closed position will now be discussed. The production ports 50 are isolated from the well annulus (only seal assembly 24 is shown in FIG. 3). The inner mandrel 6 is in the closed position, which isolates the inner bore of the mandrel from the well annulus. The leading edges 60, 62 are positioned right before the header seal ring 114.

With the sleeve assembly 2 in the closed position and the annulus pressure higher than the tubing pressure, the equalizing seal means 76 will produce a thrust load on the seal stacks. This will cause the eight seal rings (namely seals 82, 90, 94, 98, 102, 106, 110 and 114) to flare and bear on the retaining components (sleeve, body, and top connector, outer mandrel 4, inner mandrel 6, radial shoulder 20, and radial end 22). The seal rings that are facing away from the pressure (82, 90, 94, 98) will not hold pressure. If pressure gets pass the equalizing seal 76, the pressure will force the flanks of the seal ring in or away from the retaining components. For the remaining seal rings (102, 106, 110, 114), pressure will cause the seal ring to flare against the retaining components (outer mandrel 4, inner mandrel 6, radial shoulder 22, and radial end 20) so that pressure is held.

In the scenario wherein the sleeve assembly 2 is in the closed position, and the tubing pressure is greater than the annulus pressure, the follower seal ring 100 will produce a thrust load on the seal rings (82, 90, 94, 98) in the direction of the equalizing seal means 76. This will cause the four seal rings between the equalizing seal means 76 and the follower seal ring 100 (82, 90, 94, 98) to flare and bear on the retaining components (inner mandrel 6, outer mandrel 4, and radial shoulder 32). The seal rings (102, 106, 110, 114) that are facing away from the tubing pressure will not hold pressure. For the remaining seal rings (82, 90, 94, 98), pressure and thrust loads will cause the seal ring to flare against the retaining components (inner mandrel 6, outer mandrel 4, radial shoulder 32) creating a seal. Please note that in one preferred embodiment, the use of the non-extrusion rings is optional.

Figure 2B:
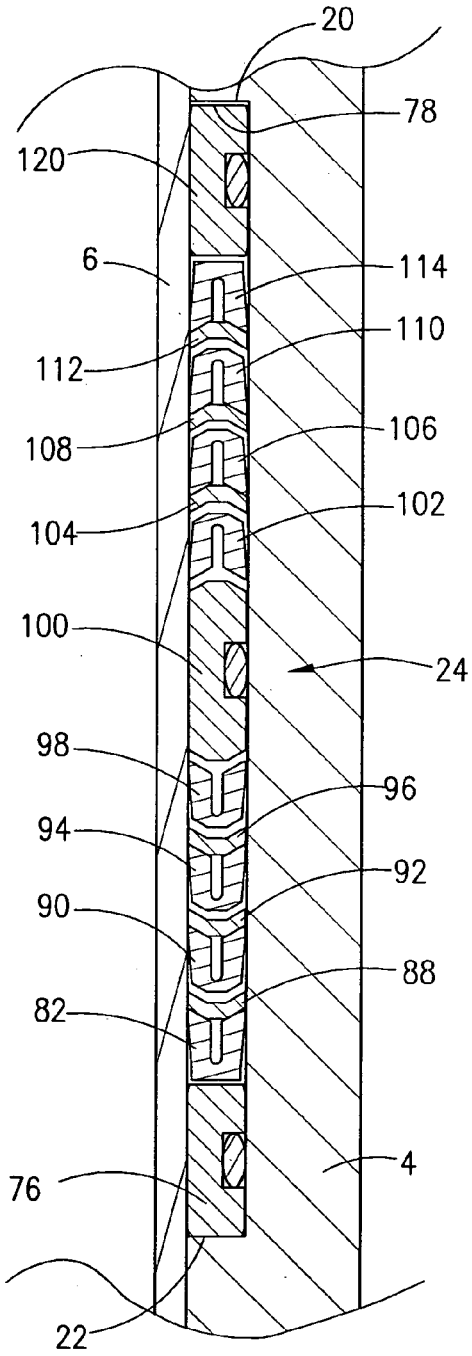
FIG. 2B is an exploded view of a second embodiment of the seal assembly taken from FIG. 1B.

As seen in FIG. 2B, in one preferred embodiment, it is possible to add an equalizing seal means or a follower seal ring (an equalizer seal ring 120 is shown in FIG. 2B), represented by the numeral 120 on the tubing pressure side of the seal assembly 24. It should be noted that like numbers appearing in the various figures refer to like components. Since a seal ring means may not set correctly without a thrust load at elevated temperatures, the equalizer seal means 120 (or additional follower seal ring) can enhance the seal assembly 24 for sealing.

Figure 2C:
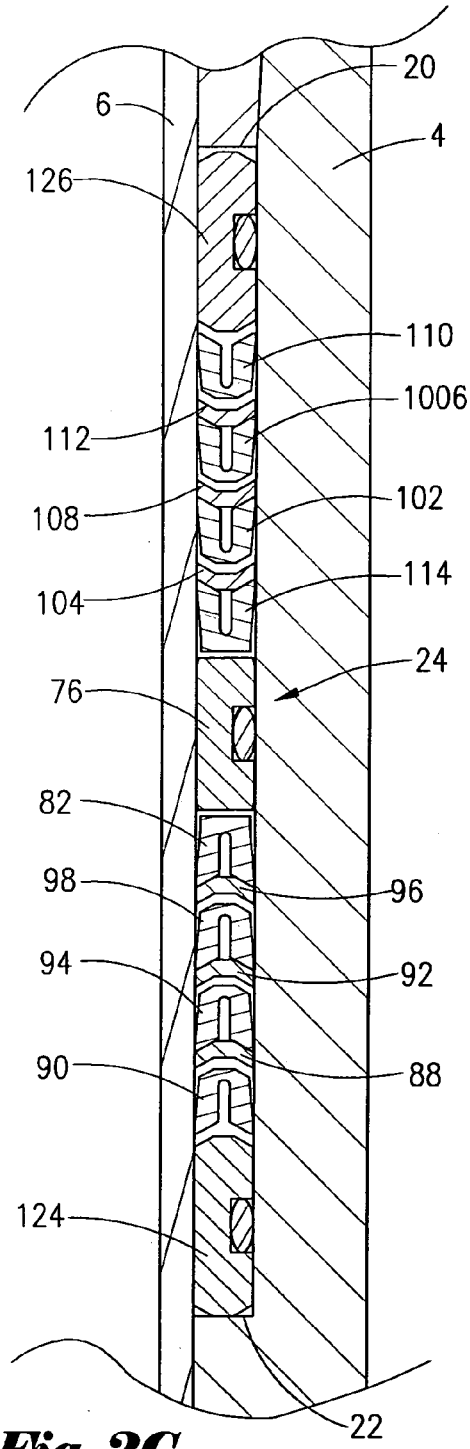
FIG. 2C is an exploded view of a third embodiment of the seal assembly taken from FIG. 1B.

In another embodiment, seen in FIG. 2C, the seal rings (82, 90, 94, 98, 102, 106, 110, 114) and the non-extrusion rings (88, 92, 96, 104, 108, 112) are oriented in an opposite 180 degree plane relative to the seal assembly 24 seen in FIG. 2A. The configuration illustrated in FIG. 2C will not trap pressure between opposing seal rings and will provide thrust to energize the seal rings. Note in the embodiment seen in FIG. 2C, the header seal means 82, 114 are disposed abutting the equalizing seal 76, and two follower seal rings 124, 126 have been added to each end of the seal assembly 24. It should be noted that FIG. 2D shows the embodiment of the seal assembly 38 shown in FIG. 1B, which is the inverted arrangement of seal assembly 24.

Figure 4:
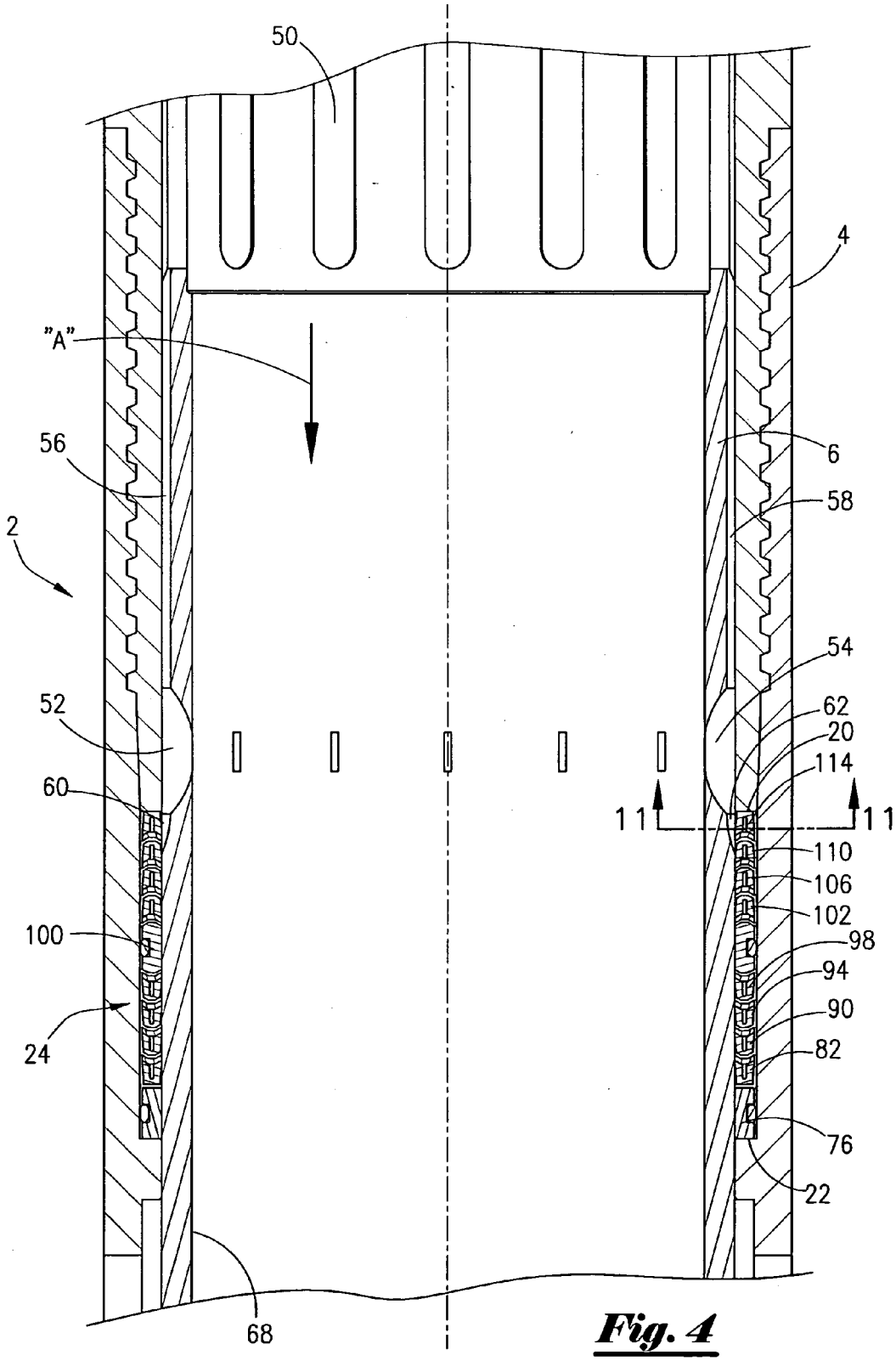
FIG. 4 is a partial cross-sectional sequential view of the sleeve device seen in FIG. 3 as the sleeve device has started to shift to the equalizing position.
Figure 11:
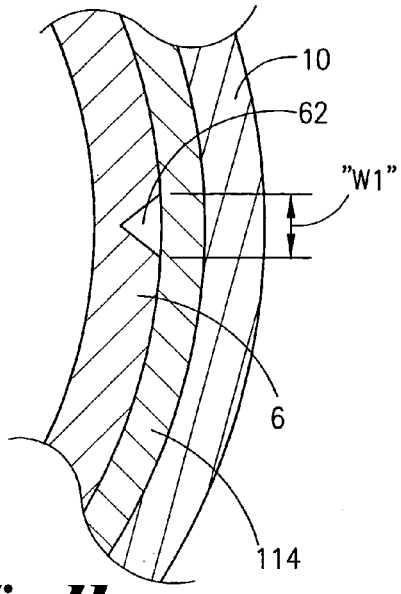
FIG. 11 is a partial cross-sectional view of the vent groove taken from line 11—11 in FIG. 4.

Referring now to FIG. 4, a partial cross-sectional sequential view of the sleeve assembly 2 seen in FIG. 3 will now be described. More specifically, the sleeve assembly 2 has started to shift to the equalizing position and wherein the annulus pressure is greater than the inner tubular pressure. This is being accomplished by the inner mandrel 6 being shifted in a first direction denoted by the arrow "A" via a shifting tool (not shown). As seen in FIG. 11, which is a partial cross-sectional view taken along line 11—11 in FIG. 4, the vent groove 58, and in particular the leading edge 62 area of the vent groove 58 is shown. In the most preferred embodiment, the vent grooves 56, 58 are narrow and shallow to prevent the seal rings 82, 90, 94, 98, 102, 106, 110, 114 from extruding into the grooves 56, 58. It has been found that if the seal rings 82, 90, 94, 98, 102, 106, 110, 114 extrude into the groove, the extruded material will be cut or torn off of the seal rings 82–114 as the production ports 50 pass the extruded material. Additionally, the non-extrusion rings also aid in preventing this extruding of the seals.

Returning to FIG. 4, note that the leading edge 60, 62 of the vent grooves 56, 58 has moved pass the header seal ring 114. This allows pressure that has been captured between the seal rings (110, 114) to vent off before the equalizing ports 52, 54 and the production ports 50 are exposed to the entire seal assembly 24.

Figure 5:
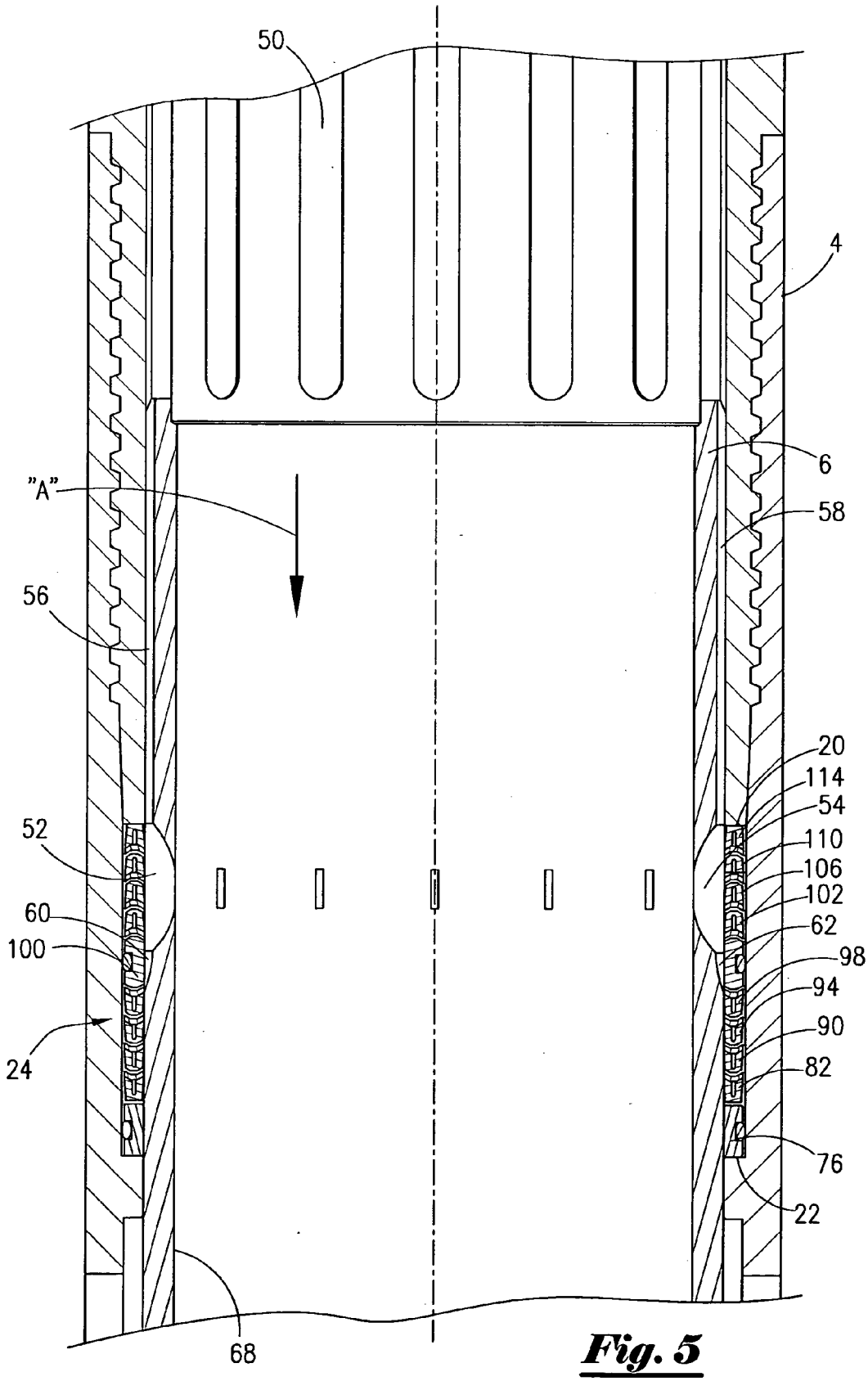
FIG. 5 is a partial cross-sectional sequential view of the sleeve device seen in FIG. 4 as the sleeve device has been shifted to the follower seal ring.

Referring now to FIG. 5, a partial cross-sectional sequential view of the sleeve assembly 2 seen in FIG. 4 is shown as the sleeve assembly 2 has been shifted to the follower seal ring 100. This means that all pressure above the follower seal ring 100 (ergo, seals 102, 106, 110, 114) has been vented to the inner portion 68 of the sleeve assembly 2, which in effect is vented to the inner tubing member to which the sleeve assembly 2 is attached, as will be understood by those of ordinary skill in the art. The result is that there is a volume of pressure that has been discharged.

Figure 6:
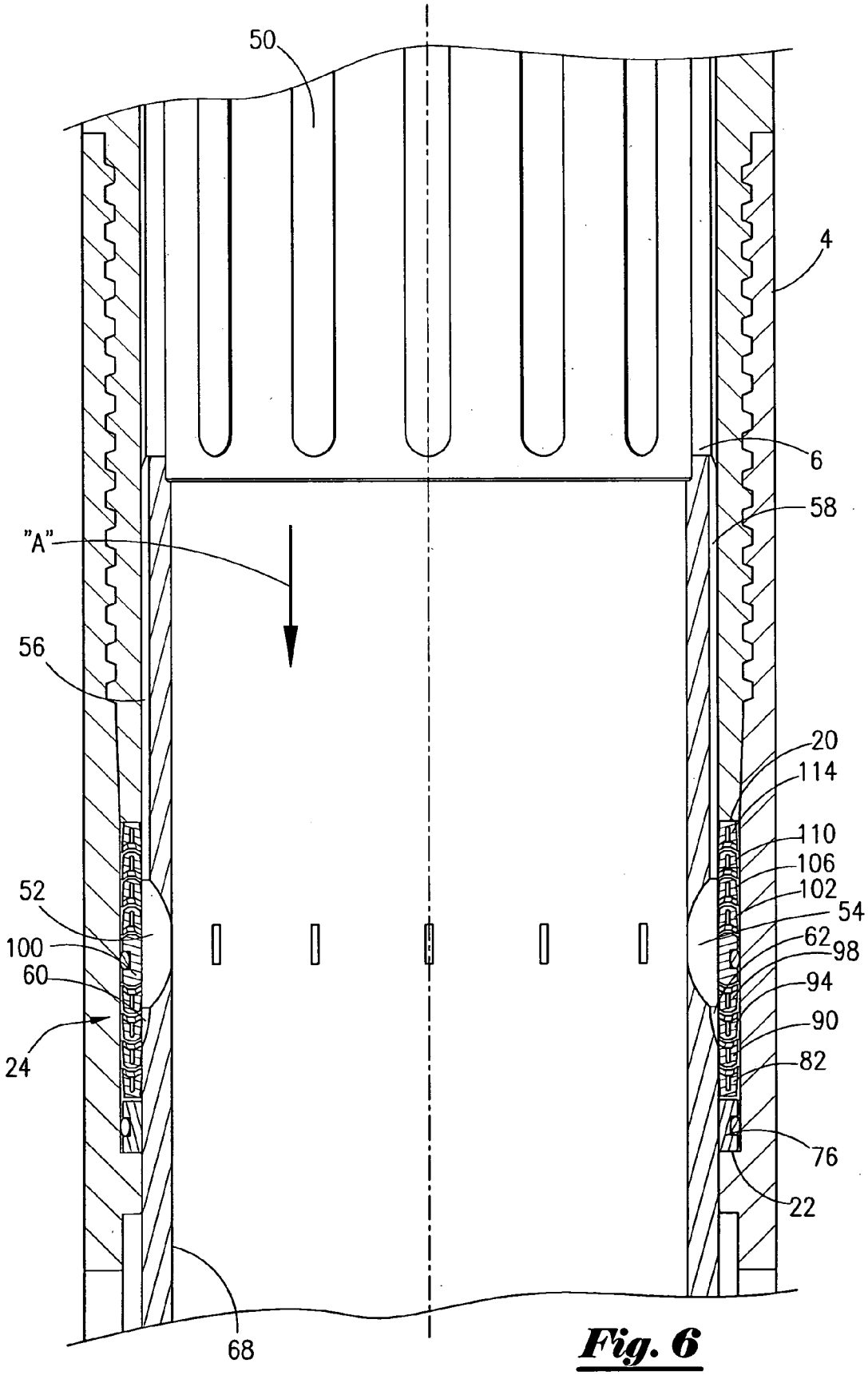
FIG. 6 is a partial cross-sectional sequential view of the sleeve device seen in FIG. 5 as the sleeve device has been shifted pass the follower seal ring.

In FIG. 6, a partial cross-sectional sequential view of the sleeve assembly 2 seen in FIG. 5 as the leading edge 60, 62 has been shifted pass the follower seal ring 100 but before the equalizing seal 76 is shown. With the sleeve in this position, pressure trapped between the equalizing seal 76 and the follower seal 100 is vented via the vent groove to production port 50. This prevents damage to the seal rings (ergo, seals 82, 90, 94, 98, 102, 106, 110, 114).

Figure 7:
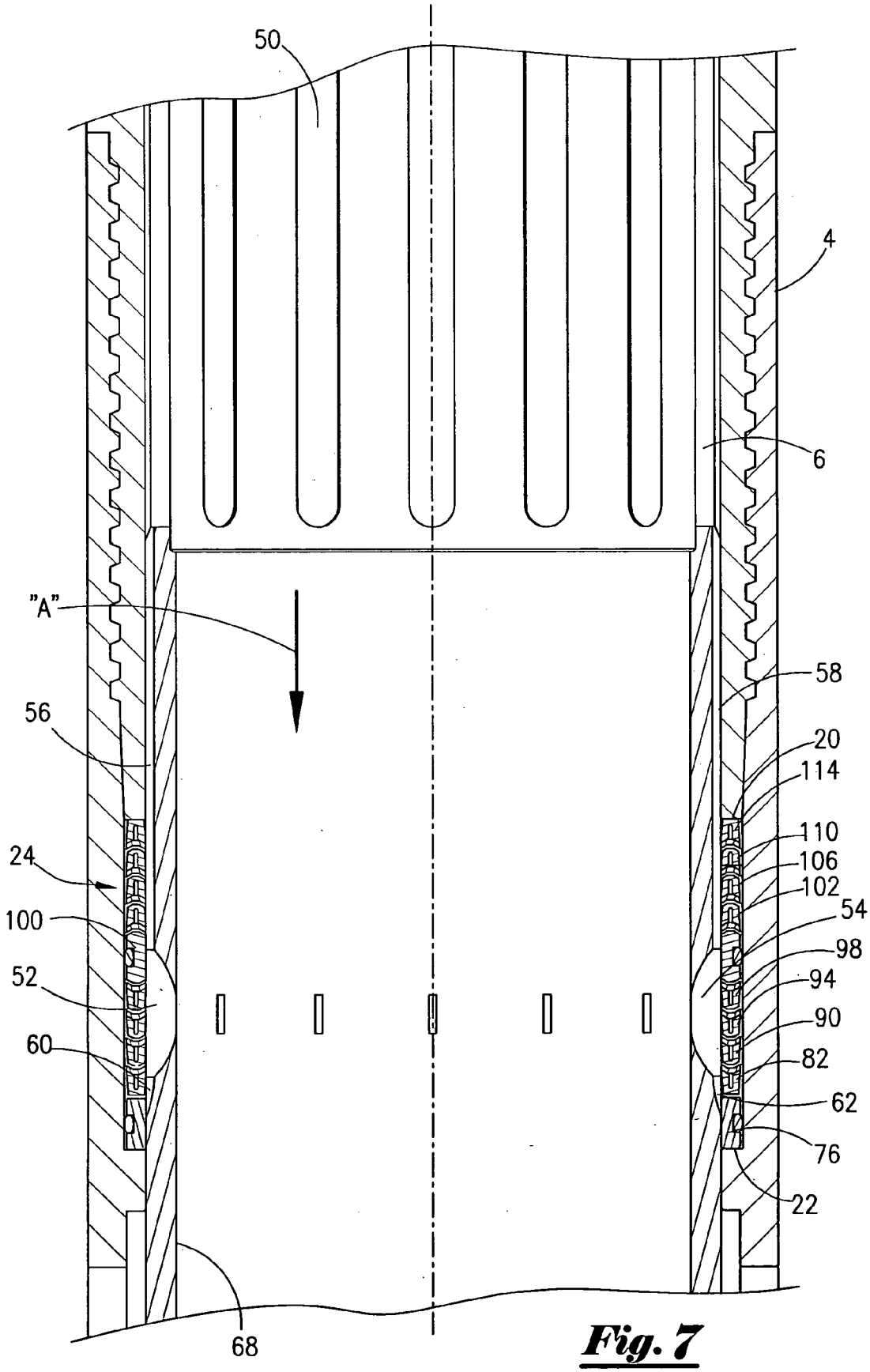
FIG. 7 is a partial cross-sectional sequential view of the sleeve device seen in FIG. 6 as the sleeve device has been shifted to the equalizing ring.

Referring now to FIG. 7, a partial cross-sectional sequential view of the sleeve assembly 2 seen in FIG. 6 as the leading edge 60, 62 has been shifted to the equalizing seal means 76. With the inner mandrel 6 moved to the equalizing seal 76, all differential pressure within the seal assembly 24 has been vented from the seal rings. Due to the vent grooves 56, 58, the sleeve assembly 2 can be opened without the seal rings trapping pressure and damaging the seal stack.

Figure 8:
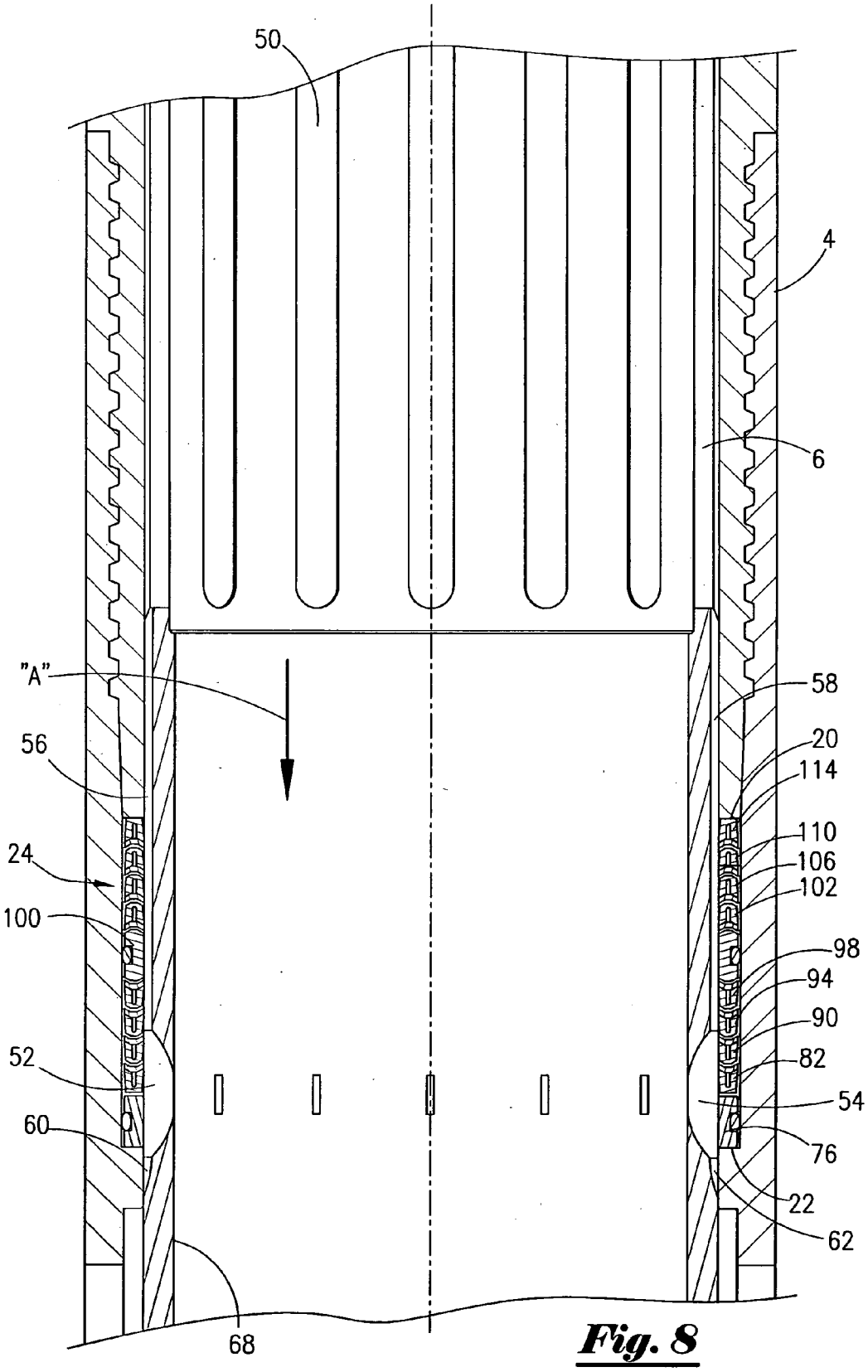
FIG. 8 is a partial cross-sectional sequential view of the sleeve device seen in FIG. 7 as the sleeve device has been shifted to a position with the vent groove and the equalizing port pass the equalizing seal.

In FIG. 8, the partial cross-sectional sequential view of the sleeve assembly 2 seen from FIG. 7 is being shifted to the position with the vent grooves 56, 58 and the equalizing ports 52, 54 pass the equalizing seal 76. In the most preferred embodiment, and as noted earlier, the equalizing seal means 76 is made of a polyester ester ketone (PEEK).

Figure 9:
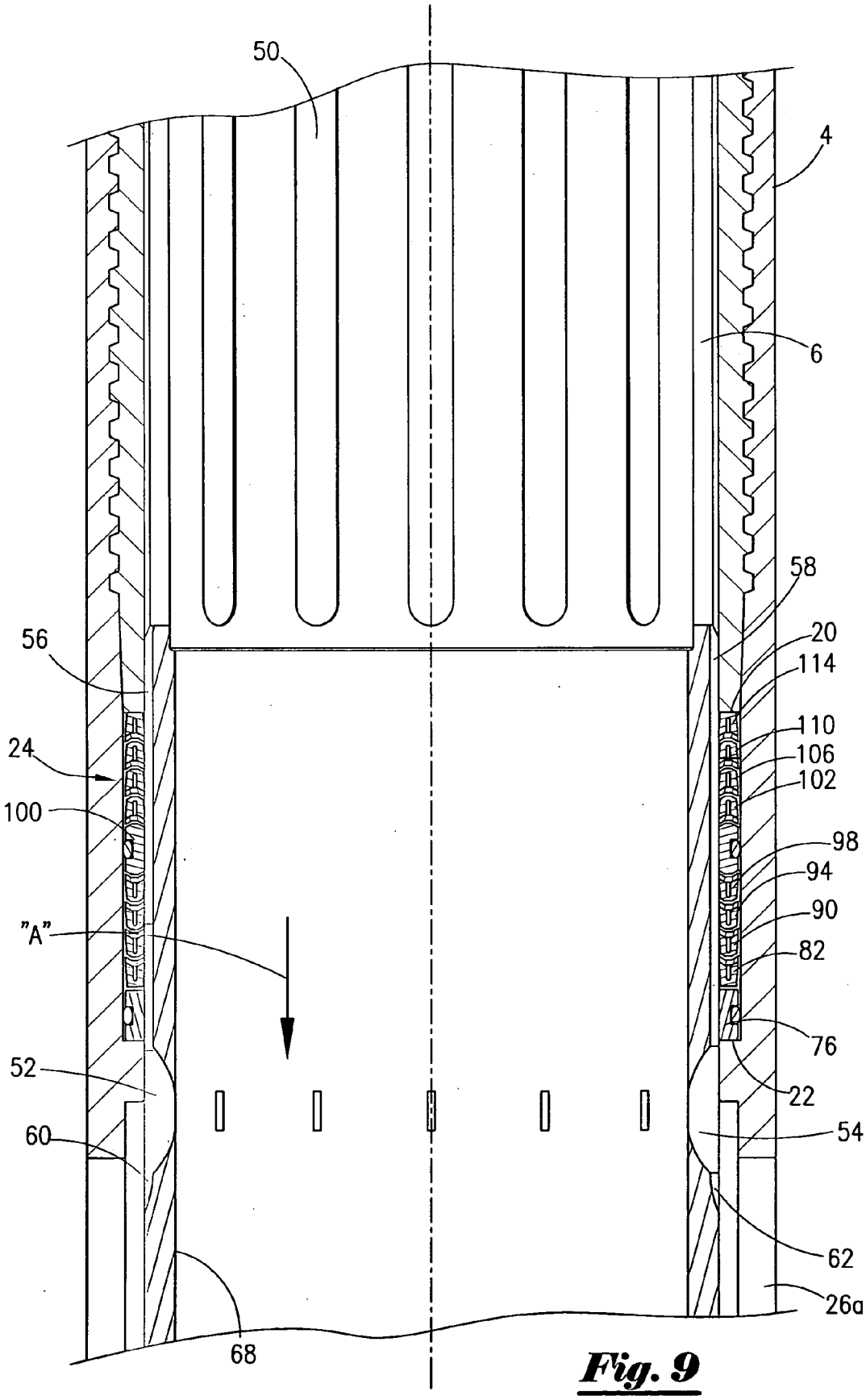
FIG. 9 is a partial cross-sectional sequential view of the sleeve device seen in FIG. 8 as the sleeve device has been shifted to the equalize position.

Referring now to FIG. 9, the partial cross-sectional sequential view of the sleeve assembly 2 seen in FIG. 8 will now be discussed in relation to the sleeve assembly 2 having been shifted to the equalize position. In this position, the annulus pressure and the tubing pressure are allowed to equalize. The seal assembly 24 at this point has been equalized to the tubing pressure. The sleeve assembly 2, and in particular the inner mandrel 6, can be shifted to the full production position without damage to the seal assemblies.

Figure 10:
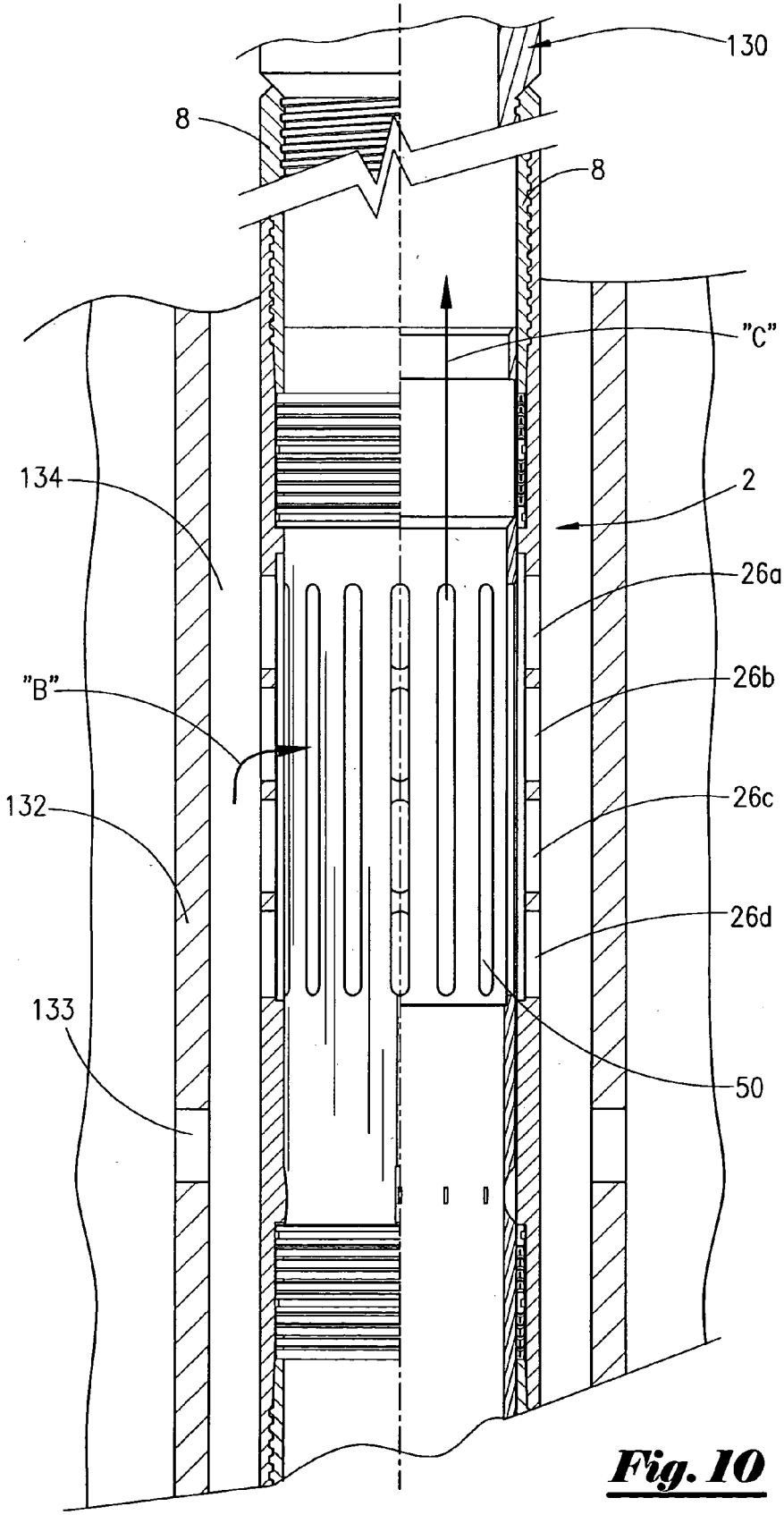
FIG. 10 is a partial cross-sectional sequential view of the sleeve device seen in FIG. 9 as the sleeve device has been shifted to the full open position.

Hence, FIG. 10 depicts the view of the sleeve assembly 2 seen in FIG. 9 as the sleeve assembly 2 has been shifted to the full open position. FIG. 10 further depicts the sleeve assembly attachment to tubing string 130, and wherein the tubing string 130 is concentrically placed within a well casing 132 completed to a subterranean reservoir that may contain hydrocarbons. The arrows "B" depicts reservoir flow from the reservoir from perforations 133 into the annulus 134 formed between the tubing string 130 and the well casing 132, through the ports 26*a*, 26*b*, 26*c*, 26*d*, then through the production ports 50 and into the inner portion of the tubing string 130. From the inner portion, the reservoir fluids and gas will be produced (as denoted by arrow "C") to surface facilities (not shown), as is well understood by those of ordinary skill in the art.

In FIG. 11, a partial cross-sectional view of the vent groove 58 taken from line 11—11 in FIG. 4 is illustrated. As noted earlier, the vent grooves are designed to vent pressure that moves pass the seal assembly during the equalizing movement or operations. Due to the volumes on both sides of the valve 2, the differential pressure still may remain after the valve 2 has been moved from the closed position to the open position. The volumes on either side of the valve 2 may be a million cubic feet. The flow area through the valve 2 is two to four times the tubing flow area for the tubing inside diameter. These flow areas are insufficient to reduce a high differential pressure between the annulus or reservoir and the tubing to the surface before the production ports pass the seal assembly. Even though the valve 2 is designed with a position stop for equalizing, it is difficult to insure that the sleeve stops at the equalizing position. As the equalizing ports pass through the seal assemblies 24 and 38, pressure is vented between each ring of the seal assembly. If the pressure is not vented or release, it will cause the seal rings to deform into the production ports as they pass through the seal assembly.

The present vent grooves 56, 58 are 0.010 to 0.015 inches wide ("W1") in the most preferred embodiment. This width "W1" is required to reduce the deformation that is caused by thrust loads on the packing. In addition, while the differential pressures are venting, the differential pressure is trying to force the seals to extrude into the vent grooves. A smaller vent groove width causes less damage to the seal assembly. If the damage is kept as small as possible, the seal ring will heal damage. The design of the vent groove can have 90-degree side or an angled side such as between 30–70 degrees, with the most preferred embodiment being a 60 degree side (FIG. 11 shows the 45-degree side). Having vent grooves designed with these criteria allows for the needed flow area.

Figure 12A:
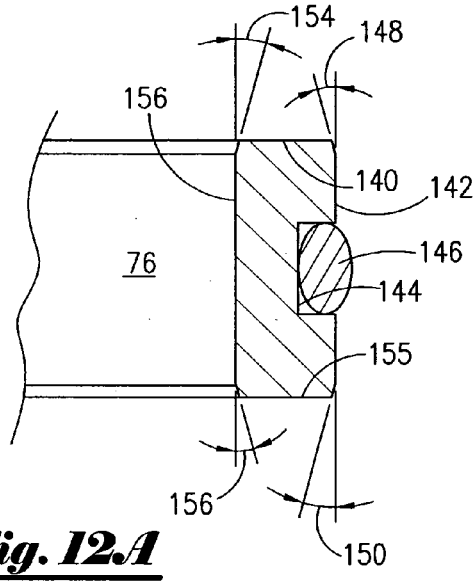
FIG. 12A is a cross-section of the preferred embodiment of the equalizing seal means.

FIGS. 12A, 12B, 12C, 12D, and 12E describe in detail the components of the seal assembly. Referring now to FIG. 12A, a partial cross-section of the preferred embodiment of the equalizing seal means 76 will now be described. As noted earlier, the equalizing seal means 76 is generally an annular ring. The equalizing seal means 76 has a first radially flat outer portion 140 that extends to the top surface 142, and wherein the surface 142 contains an annular groove 144 for placement of an o-ring 146. Note that in the preferred embodiment, the four corners having a tapered angle of approximately 15 degrees, as denoted by the numerals 148, 150, 152, 154. Additionally, note that the equalizing seal means 76 has an inner portion 155 and a bottom surface 156.

The function of the equalizing seal means 76 is to prevent high pressure/high volume from getting into the seal assembly. In one embodiment, the seal assembly is machined for a combination glass-molybdenum disulfide filled Teflon and carbon fiber-graphite filled PEEK seal rings. The equalizing seal means 76 has two different seal areas: a static seal ring and a dynamic seal ring. The static seal ring is o-ring 146 and provides a seal in a static downhole environment. The material for the o-ring 146 is chosen based on the application or environment. In the preferred embodiment, the o-ring 146 is commercially available from National O-Rings Inc. under the name Viton, and wherein Viton is a trademark of Dupont Corporation. In the most preferred embodiment, the dynamic seal ring, which is the annular ring 76 without the o-ring 146, is machined from carbon fiber-graphite filled PEEK. The PEEK ring is designed to compensate for thermal expansion, friction loads that are generated by sleeve movement, and shear loads that are caused by pressure. The dynamic seal provides a seal even when the seal assembly is undergoing expansion or contraction due to down hole pressure and temperature. The dynamic seal ring's sealing face is the bottom surface 156. The equalizing seal means 76 is a dynamic seal because it provides a seal while moving the sleeve as well as providing a seal when the seal assembly is undergoing expansion or contraction. The equalizing seal is positioned to counteract high annular differential pressures and volumes. As the sleeve moves from a closed position to an open position, the annulus pressure is prevented from damaging the seal stack. Any pressure that is trapped by the seal stack is vented through the equalizing port as it moves pass the seal stack.

The equalizing seal prevents high volume annulus fluids from re-energizing the seal stack as the sleeve moves to the open position because it will first create a seal. Once the equalizing port has moved passed the equalizing seal, the vent groove continues to vent pressure from the seal stack. Since there is no pressure being trapped by the seal stack, the production port can move through the seal stack without damage. If the seal stack has trapped pressure, the seal rings would be forced down into the production ports causing damage to the seal rings. The equalizing seal and the vent groove controls the volume of fluid pass the equalizing seal 76. In addition, the equalizing seal 76 prevents the seal rings from resealing.

Figure 12B:
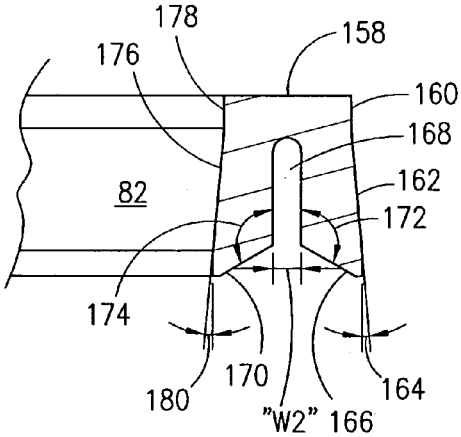
FIG. 12B is a cross-section of the preferred embodiment of the header seal ring means.

In FIG. 12B, a cross-section of the preferred embodiment of the header seal ring means 82 is illustrated. In this embodiment, the header seal ring means 82 has a first radially flat outer surface 158 that extends to a flat top surface 160 which in turn extends to the angled flank 162, and wherein the angle of the flank is approximately 5 degrees as denoted by the numeral 164. The angled flank 162 extends to a first chamfered inner side surface 166, and wherein the chamfered side surface 166 then extends to the deep set transverse groove 168. The groove 168 then extends to a second chamfered inner side surface 170. The first chamfered surface 166 has a 120 degree angle (denoted by numeral 172) relative to the groove 168; also, the second chamfererd surface 170 has a 120 degree angle (denoted by the numeral 174) relative to the groove 168. An angle between 80 degrees and 20 degrees relative to the transverse groove could be used. From the second chamfered side surface 170, the header seal ring means 82 contains an angled flank 176 that in turn extends to the flat bottom surface 178, and wherein the angle of the flank 176 is 5 degrees, as denoted by the numeral 180. Note that in one preferred embodiment, the length of the header seal ring means 82 is 0.125 inches and the length of the groove is 0.09 inches, which is a ratio of approximately 1.4 (0.125/0.09). In other words, in the most preferred embodiment, the groove should be approximately 0.72 the length of the seal ring means. The width of the groove, denoted by the "W2", is between 0.015 and 0.025 inches in the preferred embodiment.

Figure 12C:
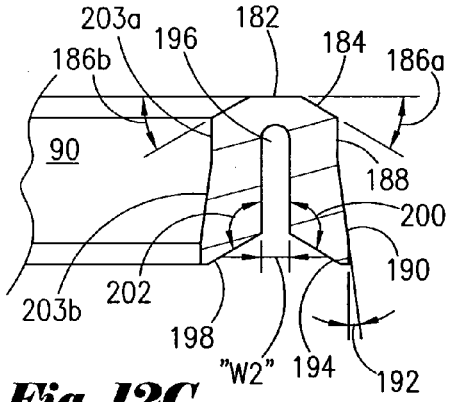
FIG. 12C is a cross-section of the preferred embodiment of the seal ring means.

FIG. 12C is a cross-section of the preferred embodiment of the seal ring means 90, which has a radially flat outer surface 182 that extends to an angled surface 184 of 30 degrees, denoted by the numeral 186*a*. The angled side 184 extends radially to the flat top surface 188 which in turn extends to an angled side 190, which has a 5 degree angle denoted by the numeral 192. Extending radially inward is the angled inner surface 194 which in turn extends to the deep set transverse groove 196. As seen in FIG. 12C, the groove 196 then leads to the angled inner surface 198. The angled surface 194 has a 120 degree orientation relative to the center line of the groove 196, denoted by numeral 200. The angled surface 198 has a 120 degree orientation relative to the center line of the groove 196, denoted by numeral 202. An angle between 80 degrees and 20 degrees relative to the transverse groove can be used. The ratio of the groove length to body length is 0.125/0.095=1.316, in the most preferred embodiment. A bottom surface 203*a* that extends to a 5 degree angled surface 203*b* is also included. A matching 30 degree angle, denoted by the numeral 186*b* is found on side adjacent the outer surface 182. The groove 196 contains a similar width "W2".

Figure 12D:
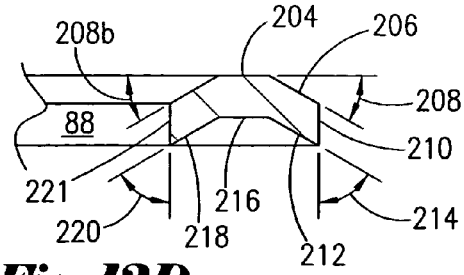
FIG. 12D is a cross-section of the preferred embodiment of the non-extrusion ring.

Referring now to FIG. 12D, a cross-section of the preferred embodiment of the non-extrusion ring 88 is illustrated. The ring 88 contains a radially flat outer end 204 that extends to the angled surface 206 wherein the angle is 30 degrees as denoted by the numeral 208*a*. The angled surface extends to the top flat surface 210 which in turn extends to the angled side 212, wherein the angled side 212 has a 60 degree angle (denoted by the numeral 214). The angled side terminates at the end surface 216, which in turn extends to the angled side 218, and wherein the angle is also 60 degrees denoted by the numeral 220. The ring 88 also contains the bottom surface 221. The side adjacent outer end 204 also a 30 degree angle denoted by the numeral 208*b*.

Figure 12E:
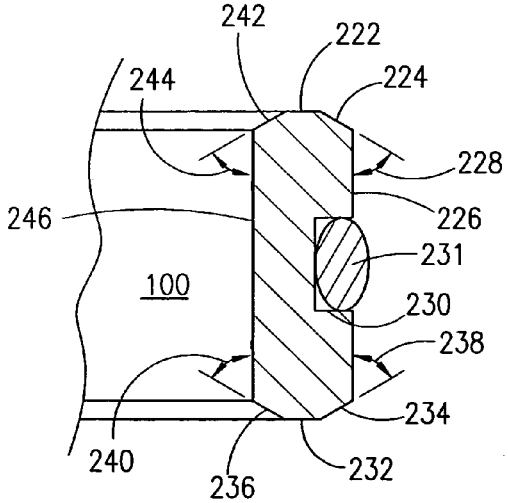
FIG. 12E is a cross-section of the preferred embodiment of the follower seal ring.

The preferred embodiment of the follower seal ring 100 is illustrated in FIG. 12E, which is a cross-sectional view. The follower seal ring 100 includes a radially flat outer end 222, that extends to the angled end 224, and wherein the angle is 60 degrees relative to the top surface 226, the 60 degree angle represented by the numeral 228. The top surface 226 contains the indentation 230 for placement of the o-ring 231 for sealing. The follower seal ring 100 also includes the radially flat inner end 232, and wherein the end 232 contains angled surfaces 234. 236, with the angles being 60 degrees denoted by the numerals 238, 240. The radially flat end 222 also contains the angled end 242, which is also angled at 60 degrees (numeral 244). The follower also contains the bottom surface 246 which is capable of also producing a sealing surface.

The follower seal ring 100 is similar to the equalizing seal ring. The beveled ends match the seal rings that mate or seat against the follower seal ring 100. The functions of the follower seal ring include to separate opposing seal rings in the seal stack assembly 24 and provide a thrust load mechanism to help energize the seal rings i.e. initiate seal rings sealing. In addition, the follower seal ring 100 also provides a bi-directional seal ring. When pressure hits the follower seal ring 100, the resulting thrust load bears against the seal rings. The thrust load causes the seal rings to flare outward against the wall of the valve which in turn creates a better seal.

Changes and modifications in the specifically described embodiments can be carried out without departing from the scope of the invention which is intended to be limited only by the scope of the appended claims and any equivalents thereof.

I claim:

1. A sliding sleeve apparatus disposed within a well so that an annulus is formed between an outer portion of the sliding sleeve and an inner portion of the well, the sliding sleeve apparatus comprising:

an outer mandrel, wherein said outer mandrel contains an annulus port;

an inner mandrel slidably disposed within said outer mandrel, said inner mandrel containing an inner portion and an outer portion, and wherein said inner mandrel contains a production port, and an equalizing port;

an indentation formed on said outer mandrel and wherein an annular seal assembly is disposed within said indentation, said seal assembly engaging said outer portion of said inner mandrel so that pressure from the annulus is isolated from the inner portion of the inner mandrel;

and wherein said seal assembly comprises:

a first header seal member;

a first seal ring means, abutting said first header seal member, for sealing with the outer portion of said inner mandrel;

a follower seal member abutting said first seal ring means;

a second seal ring means, abutting said follower seal member, for sealing with the outer portion of said inner mandrel;

a second header seal member abutting said second seal ring means;

an equalizing seal member abutting said second header seal member;

a vent groove disposed on the outer portion of said inner mandrel, said vent groove having a leading edge that extends through said equalizing port and wherein said vent groove further extends to said production port.

2. The sliding sleeve apparatus of claim 1 wherein said sliding sleeve apparatus has an open position and a closed position and wherein in the closed position said equalizing port and said production port are isolated from the annulus port and wherein in the open position the annulus port and the production port are aligned so that the annulus and the inner portion of the inner mandrel are in communication.

3. The sliding sleeve apparatus of claim 2 wherein said first and second seal ring means are constructed of Teflon.

4. The sliding sleeve apparatus of claim 2 said first and second seal ring means comprises a first seal ring abutting a non-extrusion seal member.

5. The sliding sleeve apparatus of claim 4 wherein said first header seal member comprises a radially flat outer portion and an angled inner side portion, wherein said angled inner portion is between 80 degrees and 20 degrees relative to a transverse groove.

6. The sliding sleeve apparatus of claim 5 wherein said first and second seal ring comprises a curved outer portion and an angled inner portion, wherein said angled inner portion is between 80 degrees and 20 degrees relative to a transverse groove.

7. The sliding sleeve apparatus of claim 6 wherein said follower seal member contains a cavity for placement of an o-ring, and wherein said o-ring will engage the inner portion of the outer mandrel and wherein the follower seal member provides for a thrust load mechanism to energize the first and second seal ring means.

8. The sliding sleeve apparatus of claim 7 wherein said equalizing seal member contains a top surface that includes a cavity for placement of an o-ring, and wherein said o-ring will engage the inner portion of the outer mandrel providing a static seal, and wherein a bottom surface provides for a dynamic seal with the inner mandrel.

9. The sliding sleeve apparatus of claim 8 wherein said well is completed to a hydrocarbon bearing subterranean reservoir and said sliding sleeve is part of a production tubing string so that hydrocarbons can be produced from the reservoir through the sliding sleeve and into an inner portion of the production tubing string.

10. A valve apparatus disposed within a well so that an annulus is formed between an outer portion of the valve apparatus and an inner portion of the well, the valve apparatus comprising:

an outer mandrel, wherein said outer mandrel contains an annulus port;

an inner mandrel slidably disposed within said outer mandrel, said inner mandrel containing an inner portion and an outer portion, and wherein said inner mandrel contains a production port, and an equalizing port;

a seal assembly disposed within an indentation formed on said outer mandrel, said seal assembly engaging said outer portion of said inner mandrel so that pressure from the annulus is isolated from the inner portion of the inner mandrel;

and wherein said seal assembly comprises:

a header seal member;

a first seal ring with a first transverse groove, abutting said header seal member, for sealing with the outer portion of said inner mandrel;

a follower seal member abutting said first seal ring;

a second seal ring with a second transverse groove, abutting said follower seal member, for sealing with the outer portion of said inner mandrel;

an equalizing seal member abutting said second seal ring;

a vent groove disposed on the outer portion of said inner mandrel, said vent groove having a leading edge that extends through said equalizing port and wherein said vent groove further extends to said production port;

and wherein said sliding sleeve has an open position and a closed position and wherein in the closed position said equalizing port and said production port are isolated from the annulus port and wherein in the open position the annulus port and the production port are aligned so that the annulus and the inner portion of the inner mandrel are in communication.

11. The valve apparatus of claim 10 wherein said first and second seal ring includes an abutting non-extrusion seal member.

12. The valve apparatus of claim 11 wherein said header seal member comprises a radially flat outer portion and an angled inner portion, wherein said angled inner portion is between 80 degrees and 20 degrees relative to a third transverse groove within said header seal member.

13. The valve apparatus of claim 12 wherein said first and second seal ring comprises a curved outer portion and an angled inner portion, wherein said angled inner portion is between 80 degrees and 20 degrees relative to said third transverse groove within said header seal member.

14. The valve apparatus of claim 13 wherein said follower seal member comprises a cavity for placement of an o-ring, and wherein said o-ring will engage the inner portion of the outer mandrel and wherein the follower seal member provides for a thrust load mechanism to energize the first and second seal ring.

15. The valve apparatus of claim 14 wherein said equalizing seal member contains a top surface that includes a cavity for placement of an o-ring, and wherein said o-ring will engage the inner portion of the outer mandrel providing a static seal, and wherein a bottom surface provides for a dynamic seal with the inner mandrel.

16. The valve apparatus of claim 15 wherein said well is completed to a hydrocarbon bearing subterranean reservoir and said sliding sleeve is part of a production tubing string so that hydrocarbons can be produced from the reservoir through the sliding sleeve and into an inner portion of the production tubing string.

17. The valve apparatus of claim 16 wherein said first and second seal ring are selected from a group consisting of a Teflon material or a PEEK material.

18. A method of producing a well completed to a subterranean hydrocarbon reservoir, said well having concentrically disposed therein a tubular string, the method comprising:

providing a sliding sleeve in a closed position, said sliding sleeve comprising: an outer mandrel having an annulus port there through; an inner mandrel slidably disposed within said outer mandrel, said inner mandrel containing an inner portion and an outer portion, and wherein said inner mandrel contains a production port and an equalizing port; a seal assembly disposed about said outer mandrel, said seal assembly engaging said outer portion of said inner mandrel so that pressure from the reservoir is isolated from the inner portion of the inner mandrel; and wherein said seal assembly comprises: a first header seal member; a first seal ring member, abutting said first header seal member; a follower seal member abutting said first seal ring member; a second seal ring member; a second header seal member abutting the second seal ring member; an equalizing seal member abutting said second header seal ring member; and wherein said first and second header seal member comprises a radially flat outer portion and an angled inner portion, wherein said angled inner portion is between 80 degrees and 20 degrees relative to a transverse groove in the first and second header seal member;

shifting the inner mandrel in a first direction;

moving a leading edge of a vent groove disposed on said inner mandrel pass the first header seal member;

venting pressure between the follower seal member and the first seal ring member;

venting pressure between the follower seal member and the second seal ring member;

moving the inner mandrel so that the annulus port and the production port are aligned in an open position;

communicating an annulus area between said well and said tubular string and the inner portion of the inner mandrel;

producing hydrocarbons from the reservoir by flowing the hydrocarbons through the annulus port, production port, and into the inner portion of the inner mandrel.

19. The method of claim 18 wherein said first and second seal ring member comprises a curved outer portion and an angled inner portion, wherein said angled inner portion between 80 degrees and 20 degrees relative to a transverse groove in said first and second seal ring member.

20. The method of claim 19 wherein said follower seal member contains a cavity for placement of an o-ring, and wherein said o-ring will engage the inner portion of the outer mandrel, and said follower seal member provides a thrust load mechanism to energize the first and second seal ring member.

21. The method of claim 20 wherein said equalizer seal member contains a top surface that includes a cavity for placement of an o-ring, and wherein said o-ring will engage the inner portion of the outer mandrel providing for a static seal, and wherein a bottom surface provides for a dynamic seal with the inner mandrel.

22. The method claim 21 wherein said well is completed to a hydrocarbon bearing subterranean reservoir and said sliding sleeve is part of a production tubing string so that hydrocarbons can be produced from the reservoir through the sliding sleeve and into an inner portion of the production tubing string.

23. The method of claim 22 wherein said vent groove has a width of less than 0.015 inches.

* * * * *